US008516989B2

(12) United States Patent
Schmidt et al.

(10) Patent No.: US 8,516,989 B2
(45) Date of Patent: Aug. 27, 2013

(54) INTERNAL COMBUSTION ENGINE HAVING AN ELASTIC CONNECTING DUCT

(75) Inventors: Olaf Schmidt, Korb (DE); Christoph V. Hiller, Stuttgart (DE); Reinhard Friedrich, Waiblingen (DE); Michael Joos, Fellbach (DE); Jens Kern, Waiblingen (DE); Helmut Schlessmann, Prüm (DE)

(73) Assignee: Andreas Stihl AG & Co. KG (DE)

( * ) Notice: Subject to any disclaimer, the term of this patent is extended or adjusted under 35 U.S.C. 154(b) by 1029 days.

(21) Appl. No.: 12/552,781

(22) Filed: Sep. 2, 2009

(65) Prior Publication Data

US 2009/0314243 A1 Dec. 24, 2009

Related U.S. Application Data

(63) Continuation-in-part of application No. 10/922,332, filed on Aug. 20, 2004, now abandoned.

(30) Foreign Application Priority Data

Sep. 2, 2003 (DE) ..... 203 13 567 U

(51) Int. Cl.
*F02B 77/04* (2006.01)

(52) U.S. Cl.
USPC ..... 123/198 E; 123/184.61; 123/184.52

(58) Field of Classification Search
USPC ..... 123/198 E, 195 C, 195 A, 23.2, 36.2, 123/41.3, 590, 184.52, 65 R; 261/23.2, 36.2, 261/41.3
See application file for complete search history.

(56) References Cited

U.S. PATENT DOCUMENTS

| | | | | |
|---|---|---|---|---|
| 4,711,225 | A | 12/1987 | Holderle et al. | |
| 5,065,708 | A | 11/1991 | Wehle et al. | |
| 5,243,939 | A | 9/1993 | Viktorsson et al. | |
| 5,474,039 | A | 12/1995 | Döragrip | |
| 6,101,991 | A | 8/2000 | Glover | |
| 6,257,179 | B1 * | 7/2001 | Uenoyama et al. | 123/65 R |
| 6,334,421 | B1 | 1/2002 | Singer et al. | |
| 6,352,058 | B1 | 3/2002 | Yuasa et al. | |
| 6,640,755 | B2 | 11/2003 | Araki | |
| 6,662,766 | B2 | 12/2003 | Araki et al. | |
| 2001/0011531 | A1 * | 8/2001 | Uenoyama et al. | 123/65 R |
| 2004/0025817 | A1 * | 2/2004 | Uenoyama et al. | 123/73 A |

FOREIGN PATENT DOCUMENTS

| | | |
|---|---|---|
| DE | 2742616 | 3/1979 |
| GB | 1315618 | 5/1973 |
| JP | 2002242679 | 8/2002 |
| WO | WO00/43660 | 7/2000 |
| WO | WO0043650 | 7/2000 |

* cited by examiner

*Primary Examiner* — Noah Kamen
*Assistant Examiner* — Hung Q Nguyen
(74) *Attorney, Agent, or Firm* — Robert W. Becker; Becker & Stachniak, P.C.

(57) ABSTRACT

An internal combustion engine of a manually operated implement, having an elastic connecting duct between the engine and an air filter for vibration-decoupled bridging of a vibration gap between engine and the air filter. The elastic connecting duct has a first conduit for fuel/air mixture and a second conduit for largely fuel-free air. The first and second conduits are separate tubes having respective bores that are separated from one another over their entire lengths, the inlet of the engine is operatively connected to the air filter via the first conduit, and an air duct window of the engine is operatively connected to the air filter via the second conduit.

24 Claims, 8 Drawing Sheets

INTERNAL COMBUSTION ENGINE HAVING AN ELASTIC CONNECTING DUCT

CROSS-REFERENCE TO RELATED APPLICATIONS

This application is a continuation-in-part of application Ser. No. 10/922,332 filed Aug. 20, 2004, now abandoned.

BACKGROUND OF THE INVENTION

The invention relates to an internal combustion engine having an elastic connecting duct between an air filter and the internal combustion engine of a manually operated implement such as a power chain saw, a cut-off machine, or the like, whereby the connecting duct is a monolithic component.

A connecting duct which connects the carburetor of a manually operated implement to the combustion chamber of the internal combustion engine is known from U.S. Pat. No. 4,711,225. In order to improve the exhaust emission specifications of a two-cycle engine largely fuel-free air is advanced in the transfer passages in a known process. The air advanced in the transfer passages must then be fed from the air filter to the two-cycle engine. In known two-cycle engines this tales place via separate lines. They each have a connecting duct or another element to bridge the vibration gap between the air filter and the internal combustion engine. This results in tool of complex design and complex assembly.

The object of the invention is to provide a connecting duct of the aforementioned general type which permits a simple design and assembly of the implement.

SUMMARY OF THE INVENTION

This object is achieved by means of a having a first conduit for fuel/air mixture, and a second conduit for largely fuel-free air.

Since a single connecting duct contains both a conduit for fuel/air mixture and a conduit for largely fuel-free air, there is no need for multiple components, connecting ducts or elements to make the connection to the carburetor. It is simply necessary to fit a single connecting duct. This reliably prevents any short circuit between the two conduits. There is no need for a separate channel for the supply of largely fuel-free air. The design of the two channels as separate conduits effects the permanent, vibration-decoupled bridging of the vibration gap between the air filter and the internal combustion engine. The design of the connecting duct and the two conduits in one piece results in a tool of low weight.

For easy fitting to the internal combustion engine, the connecting duct has a connecting flange to connect it to the internal combustion engine into which both conduits flow. In order to achieve sufficient mechanical stability of the connecting flange, it is designed with a core which is at least partially extrusion-coated with an elastic material, in particular the material of the conduits.

The connecting flange expediently has fixing openings by which the flange is mounted, in particular screwed tight, onto the internal combustion engine. The fixing openings permit simple fitting in a direction perpendicular to the plane of the connecting flange. The fixing openings are advantageously formed in sleeve-shaped receivers which pass right through the connecting flange. They can be made to pass directly through the connecting flange easily by not including the sleeve-shaped receivers in the extrusion-coating process. A simple design is created if the sleeve-shaped receivers are made as one piece with the core. In this arrangement, the sleeve-shaped receivers are advantageously set back by a certain distance in relation to the flange plane so that the force of the fixing means, e.g. screws, is applied to the flange in a by-pass via the sleeve-shaped receivers. This allows a defined surface pressure to be achieved in the connecting plane.

The core is made in particular from a duroplastic. By extrusion-coating the core, the core is positively connected to the conduits. Since the conduits are connected to one another by the elastic material of the conduits or by the core material, good thermal decoupling is achieved. It may, however, be expedient for the core to be made of metal, in particular steel. The core advantageously takes the form of a plate which is curved towards the flange plane in the area of the fixing openings. A plate core can easily be manufactured in a cost-effective manner. Due to the high stability of the core material, the connecting flange can be thin. Curving the core towards the flange plane in the area of the fixing openings creates a direct connection between the core and the flange of the internal combustion engine in the area of the fixing openings without an intermediate layer of plastic. This enables a defined pressure to be achieved at the bearing surface. At the same time it also produces a stable screw connection.

In order to achieve a good seal between the connecting flange and the internal combustion engine and between the mixture duct and the air duct, it may also be expedient to form a sealing contour on the connecting plane facing the internal combustion engine. This eliminates the need for additional sealing elements, thereby further simplifying both manufacture and fitting. The sealing contour is advantageously designed as a sealing bead positioned in a groove. The compressed sealing bead is able to expand into the groove when it comes into contact with the flange of the cylinder, thereby achieving a good seal.

Both conduits expediently have plane-parallel flange planes at the ends facing away from the connecting flange. This means that the two ducts can be fixed easily to the air filter base. In this arrangement, the flange planes are positioned in particular a certain distance apart, the first conduct advantageously being shorter than the second. Here the first conduit is advantageously connected to a carburetor. In this arrangement, the distance between the two flange planes is in particular dimensioned such that once the first conduit has been fitted to the carburetor the connections of the various ducts lie in one plane.

The first conduit advantageously has an approximately circular flow cross-section which tapers in particular in the direction of flow. This provides a good transition from the circular flow cross-section of the carburetor to the generally slightly elliptical flow cross-section at the inlet to the cylinder of the internal combustion engine. In order to achieve an even flow speed in the conduits, the flow cross-section is largely identical over the entire length of the mixture duct. The second conduit expediently has an approximately circular flow cross-section at the end facing the air filter and a flow cross-section with a minimum height measured along the longitudinal cylinder axis of the internal combustion engine which is smaller than the maximum width measured approximately around the cylinder at the end facing the internal combustion engine. In this arrangement, the minimum height of the second conduit at the end facing the internal combustion engine is in particular less than half and advantageously less than a quarter of the maximum width. This flat, wide design of the mouth opening of the conduit results in an advantageous connection geometry since the air duct in the cylinder wall is split into two branches which run along either side of the cylinder to the transfer passages. The flat, wide shape of the mouth opening also means low flow resistances if the air duct is split into two branches. At the same time, the low, wide shape means that the total height of the connecting flange can be reduced.

In order to prevent the collapse of either of the conduits in the connecting duct due to the underpressure which occurs when engine speed is reduced, at least one conduit, in particular the air duct, has at least one reinforcement. The reinforcing element advantageously takes the form of a ridge running around the conduit. However, it may also be expedient for the reinforcement to be designed as a strut which runs along the conduit. In this arrangement, the strut is positioned in particular in the area of the minimum height of the air duct since this point is particularly susceptible to collapse. The strut is advantageously positioned inside a conduit, in particular inside the second conduit. This obviates the need for external reinforcements. However, it is also possible to provide external struts and reinforcements in addition to the internal struts in order to achieve a high degree of stability. The reinforcing strut advantageously splits the conduit into two branches.

In order to achieve low flow resistance and in particular to prevent the condensation of fuel on the internal wall of the conduit in the mixture duct, the conduits have a seam-free internal wall. The connecting duct expediently has a pulse duct. The pulse duct is in particular designed in the wall of a conduit. The conduits are advantageously made of an elastomer tailored to the thermal specification, in particular a fluorine elastomer or a hydrated nitrile butadiene rubber. The connecting duct is designed as an elastomeric pre-form with a duroplastic insert which is held positively in the elastomeric pre-form. This eliminates the need for the application of bonding agents and primers to the insert in order to provide a bond.

BRIEF DESCRIPTION OF THE DRAWINGS

Embodiments of the invention are detailed below with reference to the drawings, in which.

DESCRIPTION OF SPECIFIC EMBODIMENTS

Figure 21:
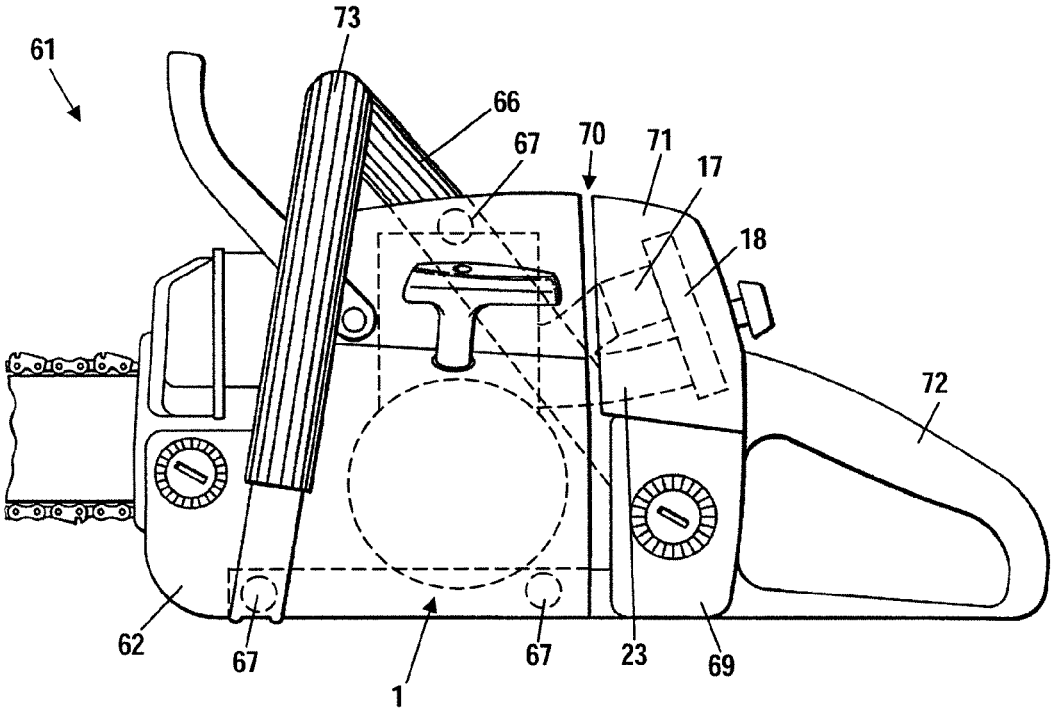
FIG. 21 shows a schematic view of a chain saw.

Referring now to the drawings in detail, as an exemplary embodiment of a manually operated implement, FIG. 21 shows a power or chain saw 61. The chain saw 21 has a housing 62 to which a handle frame 66 is secured by means of a plurality of anti-vibration elements 67, so that the handle frame 66 is uncoupled or isolated from the housing 62 with regard to vibration. A vibration gap 70 is formed between the handle frame 66 and the housing 62. The vibration gap 70 permits relative movements between the handle frame 66 and the housing 62, so that movements of the housing 62 that result from vibrations that occur during operation are not transferred, or are transferred only partially, to the handle frame 66. The handle frame 66 includes a rear handle 72, and a tubular handle 73. Connected with the handle frame 66, adjacent to the rear handle 72 are an operating medium tank 69, for example a fuel tank, and an air filter compartment 71. The air filter compartment 71 can also be connected with the handle frame 66 by means of one or more further anti-vibration elements. An air filter 18 is disposed in the air filter compartment 71.

Disposed in the housing 62 of the chain saw 61 is a two-cycle engine 1 that draws in combustion air via the air filter 18 that is disposed in the air filter compartment 71. For this purpose, the two-cycle engine 1 is connected with the air filter 18 via a connecting duct 23 that has an elastic configuration and that bridges the vibration gap 70 between the internal combustion engine 1 that is disposed in the housing 2, and the air filter 18 that is disposed in the air filter compartment 71. The connecting duct 23 is configured such that it can compensate for the relative movements that during operation occur between the internal combustion engine 1 and the air filter 18 as a consequence of the vibrations of the internal combustion engine 1.

Figure 1:
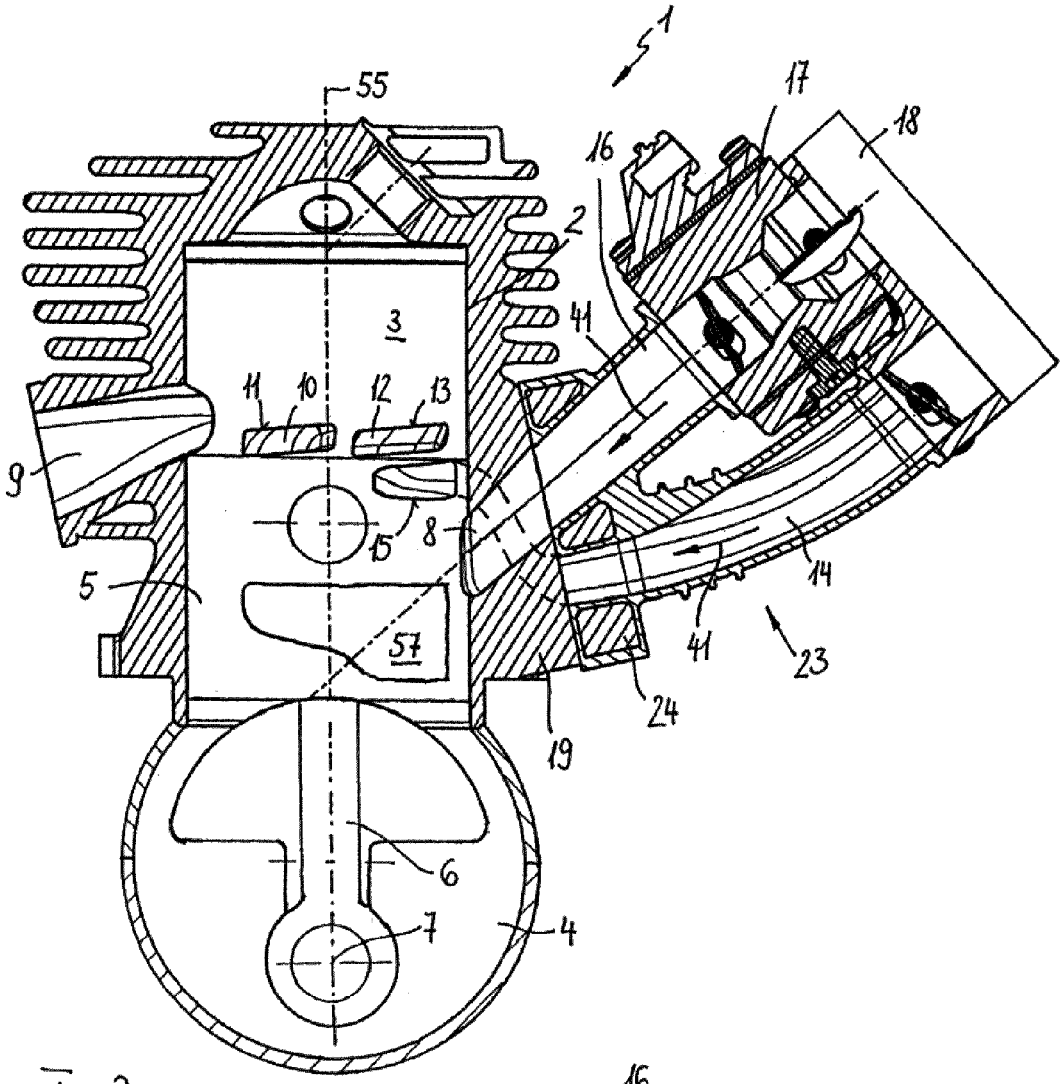
FIG. 1 shows a schematic view of a two-cycle engine.

The two-cycle engine 1 is also illustrated in FIG. 1 and has a cylinder 2 containing a combustion chamber 3. The combustion chamber 3 is delimited by a piston 5 which travels up and down and which drives a crankshaft 7 mounted in a crankcase 4 via a connecting rod 6. The two-cycle engine 1 has an inlet 8 for the supply of fuel/air mixture and an outlet 9 for the discharge of exhaust emissions from the combustion chamber 3. In pre-set piston 5 positions, the crankcase 4 is connected to the combustion chamber 3 via transfer passages 10, 12. In this arrangement there are two transfer passages 10 positioned near the outlet 9 which flow into the combustion chamber 3 at transfer windows 11 and two transfer passages 12 located some distance from the outlet 9 which flow into the combustion chamber 3 at transfer windows 13. Here the transfer passages are positioned symmetrically in relation to a central plane which comprises the longitudinal axis 55 of the cylinder and separates the inlet 8 and the outlet 9 roughly in the center. The central plane is the plane of intersection in FIG. 1.

Combustion air from the air filter 18 is fed into the two-cycle engine 1. The air filter 18 is connected to the inlet 8 via a mixture duct 16 and to an air duct window 15 via an air duct 14. In pre-set piston 5 positions, the air duct window 15 is connected to the transfer windows 11 and 13 via a piston pocket 57 such that largely fuel-free air can be advanced from the air duct 14 via the air duct window 15, the piston pocket 57 and the transfer windows 11 and 13 into the transfer passages 10 and 12. Part of the mixture duct 16 is formed in a carburetor 17 in which fuel are supplied to the combustion air from the air filter 18. The carburetor 17 is fixed to the housing of the implement and connected to a flange 19 on the cylinder 2 via the connecting duct 23 in order to bridge the vibration gap 70. Here the connecting flange 24 of the connecting duct 23 is screwed to the flange 19 of the cylinder 2. In the connecting duct 23 the combustion air or fuel/air mixture flows in the direction of flow 41 to the cylinder.

When the two-cycle engine 1 is in operation, fuel/air mixture is aspirated into the crankcase 4 via the mixture duct 16 in the area of upper dead center of the piston 5. At the same time largely fuel-free air is advanced from the air duct 14 into the transfer passages 10 and 12. As the piston 5 travels upwards, the mixture is compressed in the crankcase 4 and forced into the combustion chamber 3 in the area of bottom dead center of the piston 5. Here the advanced, largely fuel-free air which separates the exhaust gas still in the combustion chamber 3 from the fuel/air mixture flowing in behind it leaves the transfer passages 10, 12. The exhaust gases flow through the outlet 9 out of the combustion chamber 3. At the next upward stroke of the piston 5, the fuel/air mixture is further compressed in the combustion chamber 3 and ignited by a spark plug (not illustrated) in the area of upper dead center of the piston 5. This accelerates the piston 5 towards the crankcase 4 again.

Figure 2:
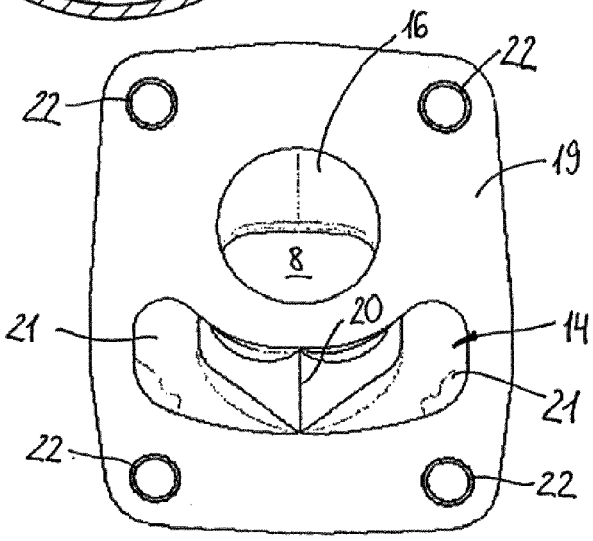
FIG. 2 shows a top view of the flange of the cylinder of the internal combustion engine illustrated in FIG. 1.

FIG. 2 shows a top view of the flange 19 of the cylinder 2. The flange 19 is approximately rectangular in shape and has a hole 22 at each of its corners into which are screwed the connecting flange 24 of the connecting duct 23. In the flange 19, the air duct 14 splits into two branches 21. A flow divider 20 which extends to the plane of the flange 19 and runs approximately parallel to the longitudinal axis 55 of the cylinder is provided to split the air duct 14. In the area of the flange, the two branches 21 of the air duct 14 run on either side of the mixture duct 16 to the opposite side.

Figure 3:
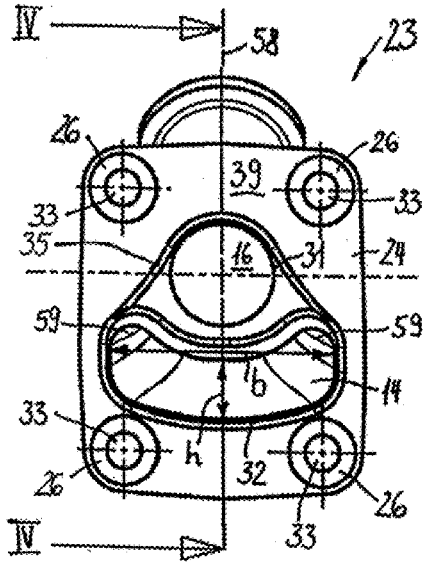
FIG. 3 shows a top view of the flange of a connecting duct.

FIG. 3 shows a top view of the connecting flange 24 of the connecting duct 23. The mouth opening 31 of the mixture duct 16 is positioned in the connecting plane 39 of the connecting flange 24. The mouth opening 32 of the air duct 14 is flat and runs symmetrically to the central line 58 of the connecting duct 23. In a connecting duct 23 fitted to the two-cycle engine 1, the central line 58 runs parallel to the longitudinal axis 55 of the cylinder. In the area of the central line 58, the mouth opening 32 has a minimum height (h). Here the height (h) is measured parallel to the central line 58. The width (b) of the mouth 32 measured perpendicular to the height (h) is significantly greater than the height (h) and the diameter of the mouth opening 31 of the mixture duct 16.

The height (h) is in particular less than half, and preferably less than one quarter, of the width (b). On both sides of the central line 58 the mouth openings 32 have widened areas 59 where the height of the mouth opening 32 is greater than the minimum height (h).

The connecting plane 39 is approximately rectangular in shape, the long sides being curved slightly outwards. Positioned in the corners of the connecting plane 39 are four sleeve-shaped receivers 26 in which are formed fixing holes 33. The sleeve-shaped receivers 26 pass right through the connecting flange 24. Formed on the connecting plane 39 of the connecting flange 24 is a sealing bead 35 which seals the ducts 14 and 16 against one another and against the environment at the flange 19.

Figure 4:
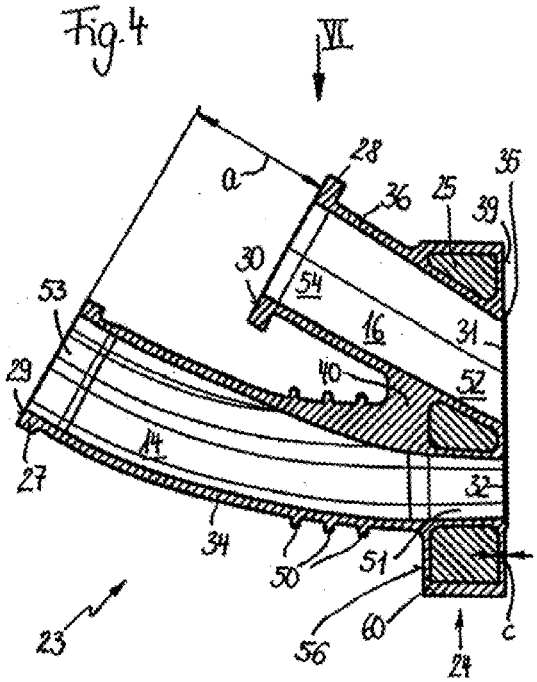
FIG. 4 shows a section through the connecting duct illustrated in FIG. 3 along the line marked IV-IV in FIG. 3.

FIG. 4 shows a section through the connecting duct 23. The connecting duct 23 has a first conduit 36 through which runs the mixture duct 16 and a second conduit 34 through which runs the air duct 14. The conduits 34 and 36 run to the mouth openings 31 and 32 at the connecting flange 24 in the connecting plane 39. The first conduit 36 has an approximately circular cross-section at both its engine-side end 52 and at its opposite, carburetor-side end 54. In this arrangement, the flow cross-section in the first conduit 36 is approximately constant from the carburetor-side end 54 to the engine-side end 52. The engine-side end 51 of the second conduit 34 is flat, while the opposite, carburetor-side end 53 has an approximately circular flow cross-section. The cross-section of the second conduit 34 is approximately constant from the carburetor-side end 53 to the engine-side end 51. The conduits 34, 36 are designed such that they can be manufactured in an injection molding process with drawn back cores.

Formed on the carburetor-side end 54 of the first conduit 36 is a connecting flange 28 which has a flange plane 30. Formed on the air filter-side end 53 of the second conduit 34 is a connecting flange 27 which has a flange plane 29. The flange planes 29 and 30 run plane-parallel to one another and are positioned a distance (a) apart. In this arrangement, the first conduit 36 is shorter than the second conduit 34 and the flange plane 30 is therefore closer to the connecting flange 24 than the flange plane 29. The distance (a) between the two flange planes 29 and 30 is selected in particular such that the connecting flanges 27 and 28 can be fixed directly to the carburetor. The two conduits 34, 36 run at an angle to the longitudinal axis 55 of the cylinder, thereby creating a descending gradient in the direction of flow 41 towards the two-cycle engine 1 when the implement is in the normal operating position. The distance (a) between the two flange planes 29, 30 is measured perpendicular to the flange planes 29, 30.

Figure 6:
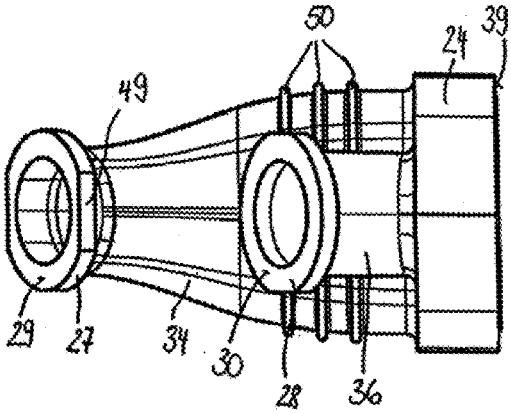
FIG. 6 shows a top view of the connecting duct illustrated in FIG. 4 in the direction of the arrow marked VI in FIG. 4.
Figure 7:
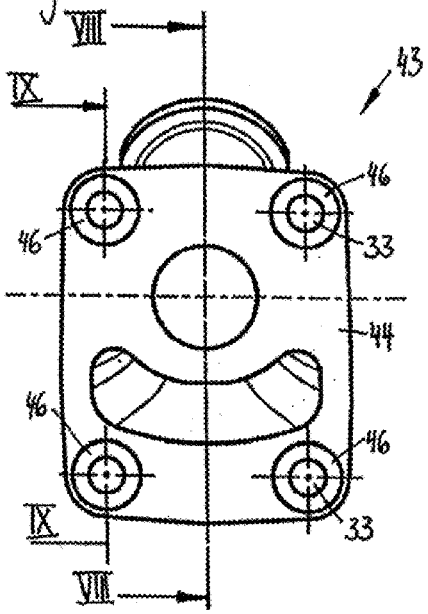
FIG. 7 shows a top view of the flange of a connecting duct.
Figure 8:
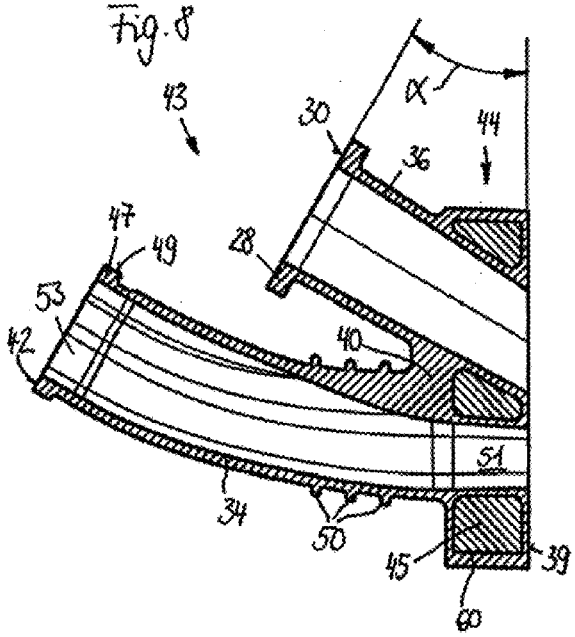
FIG. 8 shows a section through the connecting duct illustrated in FIG. 7 along the line marked VIII-VIII in FIG. 7.

The first and second conduits 34, 36 are made of an elastic material, in particular an elastomer, preferably a fluorine elastomer or a hydrated nitrile butadiene rubber (HNBR) Here the connecting duct 23 is made using the injection molding process in particular. Formed in the connecting flange 24 is a core 25 which is extrusion-coated in the connecting flange 24. The core 25 comprises of a harder material, in particular a duroplastic. The sleeve-shaped receivers 26 are formed on the core 25. In order to guarantee sufficient stability of the second conduit 34 in the area of the end 51 on the engine side, there is formed on the side 56 of the connecting flange 24 opposite the connecting plane 39 a reinforcing strut 40 which extends between the two conduits 34, 36 and runs approximately perpendicular to the connecting flange 24 along the conduits 34, 36. The second conduit 34 has a thickened section on the side facing the first conduit 36 in the area of the reinforcing strut 40. As shown in the top view given in FIG. 6, the second conduit 34 has three peripheral ridges 50 which run around it externally in an area adjacent to the reinforcing strut 40. The second conduit 34 has a flattened section 49 on the side facing the first conduit 36.

Figure 5:
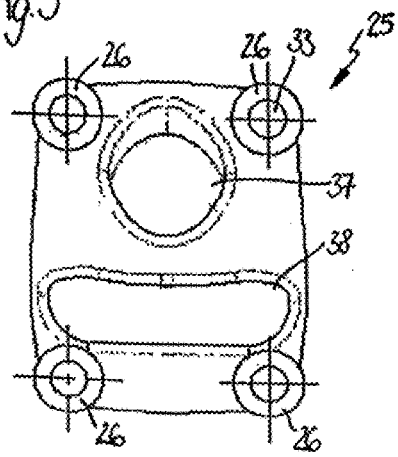
FIG. 5 shows a top view of the core of the connecting duct illustrated in FIGS. 3 and 4.

FIG. 5 shows a lateral view of the core 25. The sleeve-shaped receivers 26 are formed on the core 25. In this arrangement, the sleeve-shaped receivers 26 project out of the plane of the core 25 by approximately the thickness (c) of the casing 60 of the core 25 illustrated in FIG. 4 so that the sleeve-shaped receivers 26 end approximately level with the connecting plane 39 and the side 56 of the connecting flange 24. When fitting the connecting duct 23 to the flange 19 of the internal combustion engine 1, the sleeve-shaped receivers 26 lie on the flange 19 so that the contact force is transmitted by the sleeve-shaped receivers 26 alone. As a result, the surface pressure in the sealing bead 35 can be determined exactly. The core 25 has a mouth opening 37 which is completely extrusion-coated in elastomeric material and in which the mixture duct 16 is mounted, and a mouth opening 38 which is also completely extrusion-coated and in which the air duct 14 is mounted.

Figure 9:
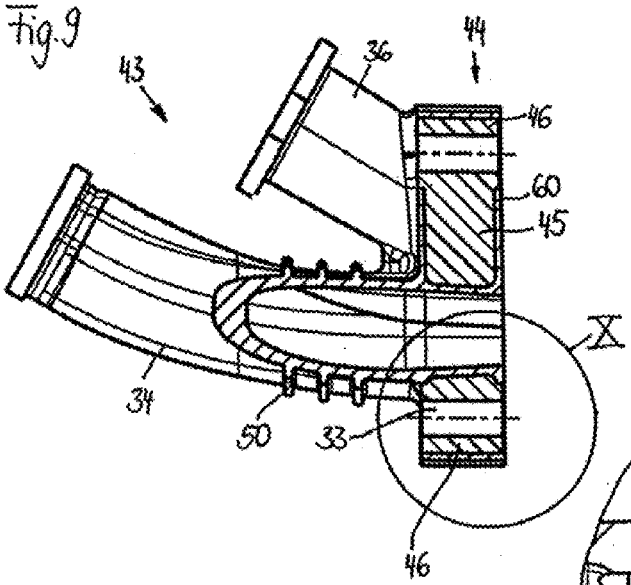
FIG. 9 shows a section through the connecting duct illustrated in FIG. 7 along the line marked IX-IX in FIG. 7.
Figure 10:
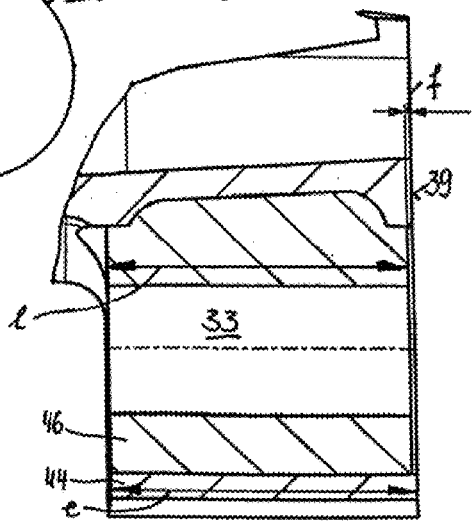
FIG. 10 shows an enlarged view of the section marked X in FIG. 9.

FIGS. 7 to 10 show an embodiment of a connecting duct 43. Here elements identical to those illustrated in FIGS. 3 to 6 are designated by means of the reference numerals used above. The connecting duct 43 has a connecting flange 44 in which is formed the core 45 illustrated in FIGS. 8 and 9. Positioned on the core 45 are four sleeve-shaped receivers 46. Positioned in the sleeve-shaped receivers 46 are fixing openings 33. As illustrated in FIGS. 9 and 10, the sleeve-shaped receivers 46 pass through the connecting flange 44. In this arrangement, the length (l) of the sleeve-shaped recess 46 is slightly smaller than the width (e) of the connecting flange 44. The sleeve-shaped receivers 46 are set back in relation to the flange plane 39 by a distance (f) which is advantageously 0.1 mm to 0.5 mm and in particular approximately 0.3 mm. When the connecting flange 44 is screwed tight against the flange 19 of a two-cycle engine 1, the casing 60 is pressed against the flange 19 and seals the connecting flange 44 against the flange 19 in a by-pass or force shunt.

The flange plane 30 at the connecting flange 28 of the first conduit 36 is inclined at an angle ($\alpha$) in relation to the connecting plane 39 of the connecting flange 44. Thus it is possible to achieve an implement of compact design. At the end 53 of the second conduit 34 on the carburetor side is a connecting flange 47 with a flange plane 42. The flange plane 42 of the connecting flange 47 runs plane-parallel to the flange plane 30 of the connecting flange 28. A compact design is achieved by means of the flattened section 49 which is fixed to the side of the connecting flange 47 facing the first conduit 36. This allows a carburetor 17 to be positioned in the area immediately above the second conduit 34.

In order to achieve greater stability of the connecting duct 43 there is fitted between the first conduit 36 and the second conduit 34 in the area of the connecting flange 44 a reinforcing strut 40 which runs perpendicular to the connecting flange 44. Moreover, the second conduit 34 has three ridges 50 in the area of its engine-side end 51 which extend in a circle around the second conduit 34. Positioned on the side of the second conduit 34 facing the first conduit 36 in the area of the ridges 50 is a thickened section. This prevents the second conduit 34 from collapsing.

It may be useful to position at least one expanding fold in one or both of the conduits 34, 36. This makes it possible to effect greater longitudinal displacement. In order to prevent the condensation of fuel or any hindrance of the flow in the conduits, the inner wall of the conduits is finished without burr, in particular with a smooth finish. This may be achieved by using an elastomeric pre-form with duroplastic inserts and closed core pullers. A further possible method of achieving a smooth inner wall in the conduits is manufacture using an injection molding technique in which the liquid plastic mass is pressed against the die walls by means of a fluid, in particular injected water. This means that no cores are required to make the conduits. It is possible to achieve a good, simple seal at the flange planes thanks to the plane-parallel design of the connecting flange. By means of further reinforcements such as ribs or an increase in wall thickness in risk areas it is also possible to adjust the collapse pressure. Thanks to the formed core, the split in the air duct can continue in the connecting flange of the connecting duct. It may be useful to provide the inner wall of the first conduit with a knurled or similar structure in order to prevent the collection of fuel droplets in the mixture duct. It may also be useful to integrate an additional pulse line parallel to the intake port.

An independent inventive idea relates to the use of a connecting flange for a two-cycle engine with a storage duct. One end of the storage duct ends at the cylinder bore in the area of the inlet 8, while the other ends at the crankcase 4. In this arrangement, both ends of the storage duct are advantageously controlled by the piston 5. As the piston travels upwards, exhaust gas from the combustion chamber 3 which is under high pressure enters the first end of the storage duct. The exhaust gas passes through the storage duct in the form of a pressure wave. Before the pressure wave reaches the second end of the storage duct, it is closed by the piston 5. The pressure wave is then reflected at the piston skirt. Rich mixture is stored in the area of the first end of the storage duct and then pushed into the combustion chamber abruptly by the reflected pressure wave. In this arrangement, the length of the storage duct is selected such that there is sufficient volume to introduce rich mixture.

In addition to the storage duct, mixture is also fed into the internal combustion engine via the mixture duct 16. In this arrangement, a section of the mixture duct 16 is formed inside a connecting duct. The connecting duct may also have only one conduit. To fix it securely to the two-cycle engine, a connecting flange with an extrusion-coated core is provided. The connecting flange is easily able to bridge the vibration gap of the two-cycle engine 1. In this arrangement, the connecting duct is advantageously positioned between the carburetor 17 and the two-cycle engine 1. The connecting duct may, however, also be provided between the air filter 18 and the carburetor 17.

Figure 11:
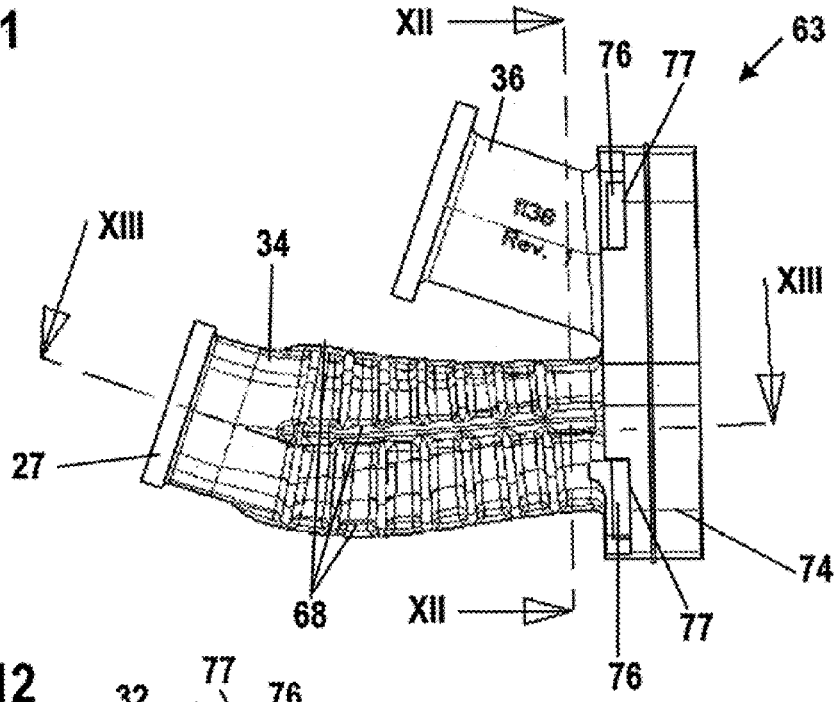
FIG. 11 shows a side view of a connecting duct.
Figure 12:
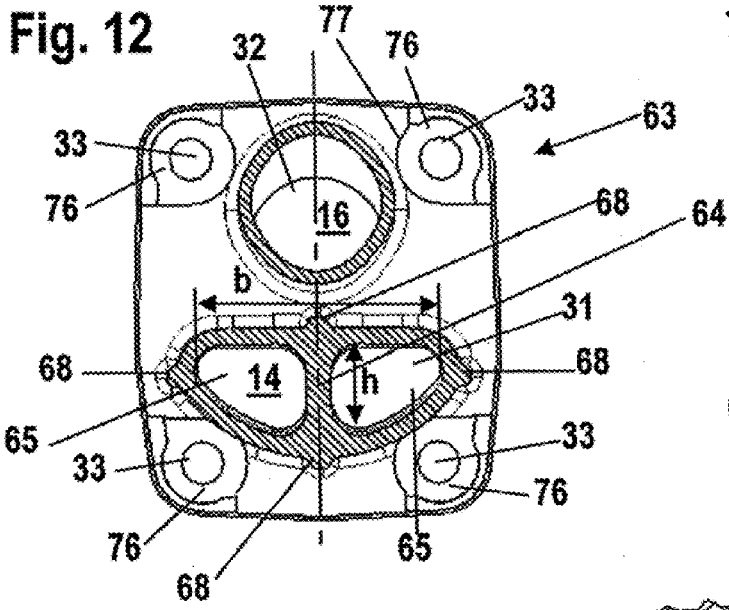
FIG. 12 shows a section through the connecting duct illustrated in FIG. 11 along the line marked XII-XII.

The connecting duct 63 illustrated in FIG. 11 has a first conduit 36 and a second conduit 34 for feeding fuel/air mixture or air respectively to the two-cycle engine. In this arrangement, components identical to those described in reference to the previous figures are designated by means of the same reference numerals. The connecting duct 63 has a connecting flange 74 with four fixing openings 33 (FIG. 12). The fixing openings 33 are formed in sleeve-shaped receivers 76 which are made as one piece with the core 75 illustrated in FIG. 13. Recessed sections 77 are provided in the area of the sleeve-shaped receivers 76 of the connecting flange 74 so that screws pushed through the fixing openings 33 only come into contact with the sleeve-shaped receiver 76 and not to the casing 60 of the connecting flange 74 illustrated in FIG. 13. On the side of the connecting flange 74 opposite the recessed sections 77, the receivers 76 are not extrusion-coated and thus sit directly on the flange 19 of an engine 1 when fitted.

The first conduit 36 has a connecting flange 28 on the side facing away from the connecting flange 74 and the second conduit 34 has a connecting flange 27. The second conduit 34 which serves to supply largely fuel-free air has longitudinally running reinforcing struts 68 on its outside. As illustrated in FIG. 12, four reinforcing struts 68 are provided.

As shown in FIG. 12, the mouth opening 32 of the air duct 14 provided in the second conduit 34 is flat and wide in shape. The width (b) in the area of the mouth opening 31 is significantly greater than the height (h). The air duct 14 is split centrally into two branches 65 by a reinforcing strut 64. The reinforcing strut 64 extends over the entire height of the second conduit 34.

Figure 13:
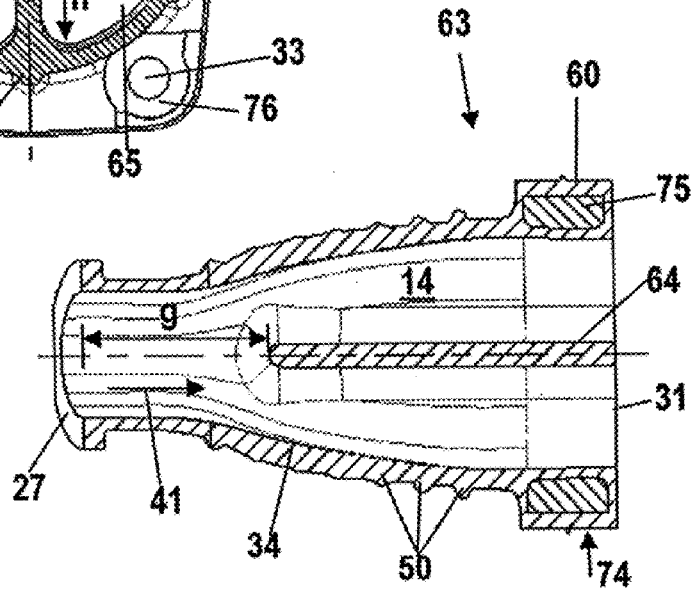
FIG. 13 shows a section through the connecting duct illustrated in FIG. 11 along the line marked XIII-XIII in FIG. 11.

A shown in FIG. 13, the reinforcing strut 64 also extends over a large part of the length of the air duct 14. In this arrangement, the reinforcing strut 64 reaches from the mouth opening 31 into the second conduit 34 and ends at a distance (g) downstream of the connecting flange 27. Here the distance (g) may be approximately one third of the axial length of the second conduit 34. As illustrated in FIG. 13, peripheral ridges 50 are also positioned around the periphery of the second conduit 34 in addition to the reinforcing struts 64. The reinforcement of the second conduit 34 may, however, simply take the form of the connecting strut 64 positioned inside the second conduit 34.

Figure 14:
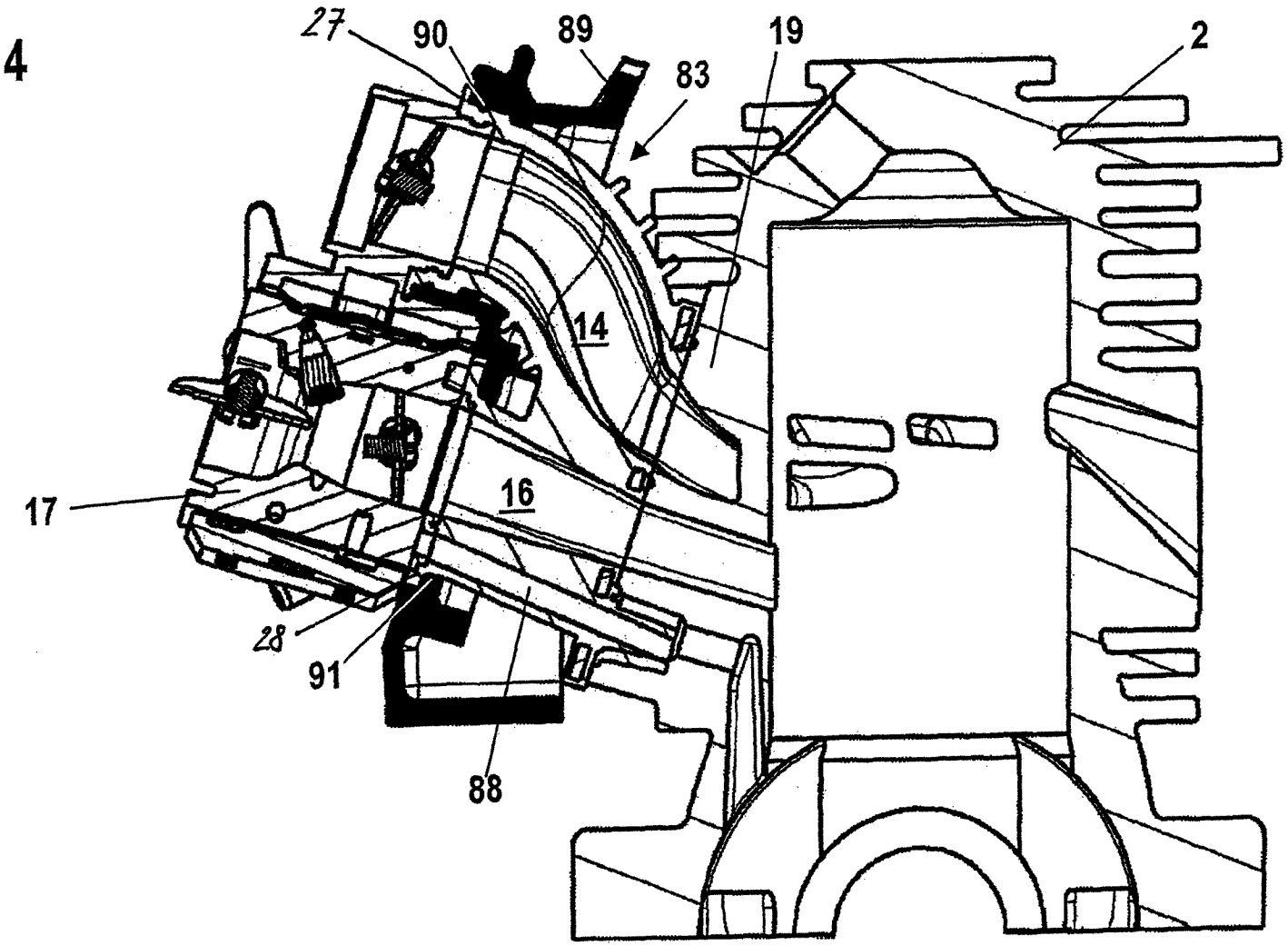
FIG. 14 shows a section through a cylinder of a two-cycle engine with a fitted connecting duct.

FIG. 14 shows the cylinder 2 of a two-cycle engine in section. The cylinder 2 has a flange 19 to which is fixed a connecting duct 83 which connects it to the carburetor 17. Provided in the connecting duct 83 is an air duct 14 and a mixture duct 16. In this arrangement, the mixture duct 16 runs below the air duct 14. In order to connect the connecting duct 83 to the carburetor 17 a locking ring 90 and a locking ring 91 are formed onto a housing part 89. The locking ring 90 is positioned in the area of the connecting flange 27 and the locking ring 91 is positioned in the area of the connecting flange 28.

Figure 16:
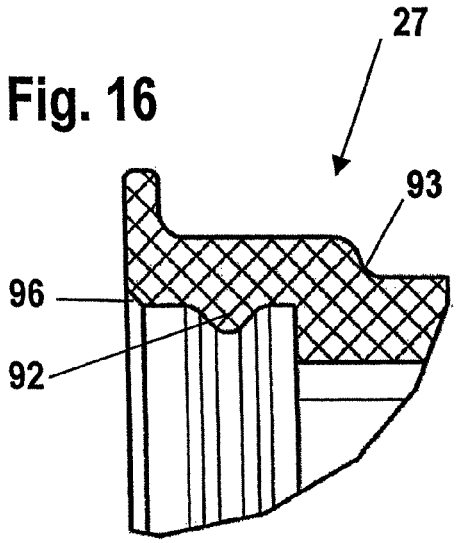
FIG. 16 shows an enlarged view of the detail marked XVI in FIG. 15.

FIG. 16 shows an enlarged view of a section of the connecting flange 27. Formed inside the connecting flange 27 is a peripheral bead 92 which projects into a recessed section in the housing of the carburetor 17. The locking ring 90 also has a corresponding bead which strongly compresses the connecting flange 27 on the outside of the bead 92. This compression effects an increase in the stability of the material of the connecting flange 27. This produces a fixed connection between the connecting flange 27 and the carburetor 17. Since the connection is formed by the housing part 89, no additional components are required. In order to push the locking ring 90 onto the connecting flange 27 more easily, a bevel 93 is provided on the connecting flange 27. Positioned on the inside of the connecting flange 27 is another bevel 96 which helps the second conduit 36 to be pushed more easily onto a connecting element formed on the carburetor 17.

Figure 15:
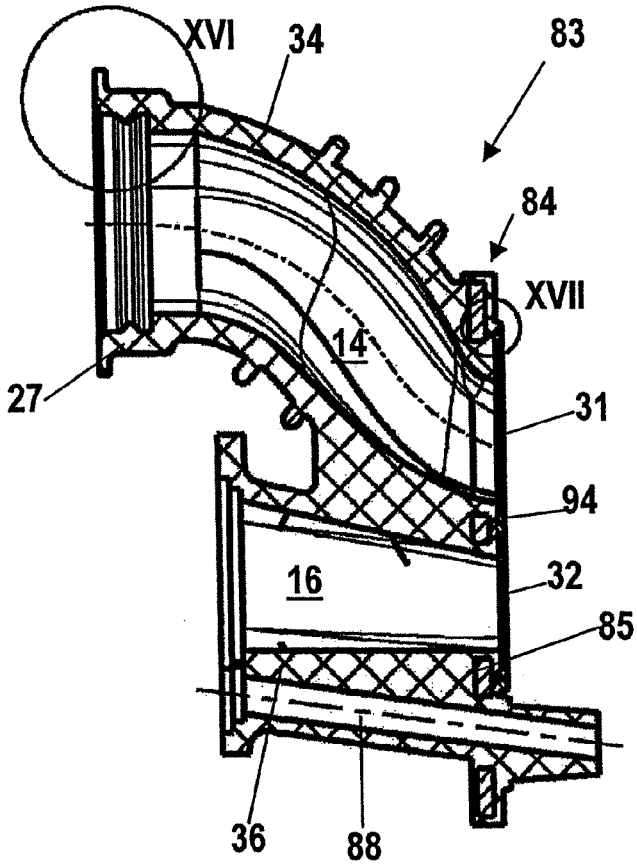
FIG. 15 shows an enlarged sectional view of the connecting duct illustrated in FIG. 14.
Figure 17:
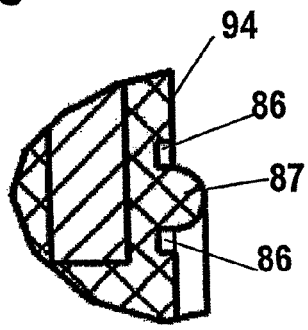
FIG. 17 shows an enlarged view of the detail marked XVII in FIG. 15.

As illustrated in FIG. 15, the connecting duct 83 has a connecting flange 84 at which are positioned a mouth opening 32 of the first conduit 36 and a mouth opening 31 of the second conduit 34. The connecting flange 84 has a core 85 which is extrusion-coated in the material of the connecting duct 83. Also provided in the connecting duct 83 is a pulse duct 88 as a further conduit. Formed onto the connecting flange 84 is a seal in the connecting plane 94 which adjoins the flange 19 of the cylinder 2. The design of the seal is shown in an enlarged view in FIG. 17. Provided as the seal is a peripheral sealing bead 87 which has a semi-circular cross-section. The sealing bead 87 is positioned in a groove 86 which runs along both sides of the sealing bead 87. When the connecting plane 94 comes into contact with the flange 19, the sealing bead 87 is compressed and is able to expand into the groove 86. This permits good contact pressure against the sealing bead 87 and thus allows a good seal to be achieved.

Figure 18:
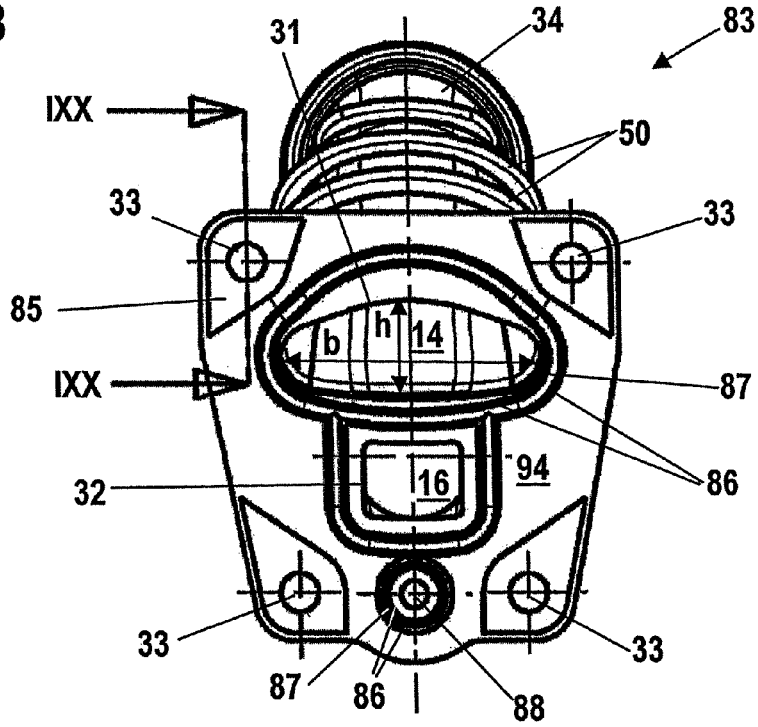
FIG. 18 shows a view of the connecting flange of the connecting duct illustrated in FIG. 14.

As shown in the view of the connecting plane 94 in FIG. 18, the sealing bead 87 runs around the mouth opening 31 of the air duct 14 and around the mouth opening 32 of the mixture duct 16. In this arrangement, the sealing bead 87 is surrounded on both sides by the groove 86. The split between the mixture duct 16 and the air duct 14 in the connecting plane 94 is formed by a common sealing bead 87. The pulse duct 88 is also surrounded by a peripheral sealing bead 87 with an adjoining groove 86 on either side. Formed around the outside of the second conduit 34 are peripheral ridges 50 which increase the rigidity of the second conduit 34. The mouth opening 31 of the air duct 14 is wide, the width (b) being significantly larger than the height (h).

Figure 19:
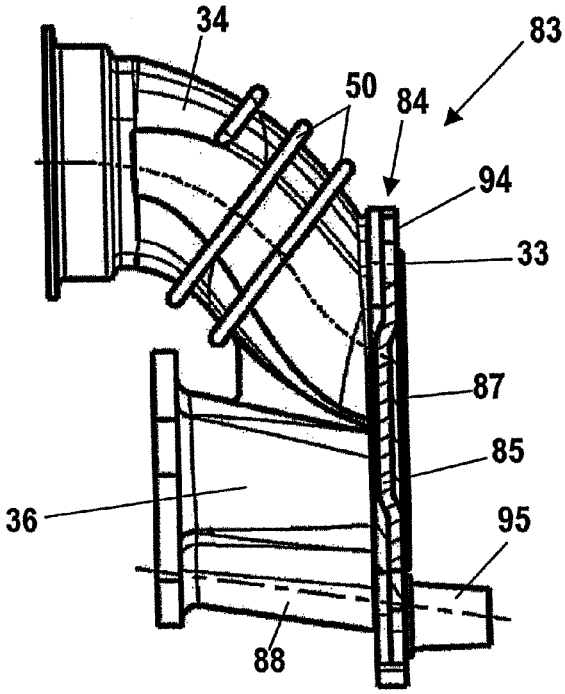
FIG. 19 shows a section through the connecting duct along the line marked IXX-IXX in FIG. 18.

The connecting flange 84 has four fixing openings 33. FIG. 19 shows a section through a fixing opening 33. As illustrated in FIG. 19, the core 85 injected into the connecting flange 84 is designed as a plate. The core 85 is in particular a steel plate. In the area of the fixing openings 33 the core 85 is curved towards the connecting plane 94 so that when fitted the area of the connecting flange 84 featuring the fixing openings 33 lies on the flange 19 of the cylinder 2. The sealing bead 87 projects beyond the connecting plane 94 so that when the connecting flange 84 is screwed down the sealing bead 87 is compressed until the area of the core 85 featuring the fixing openings 33 lies on the flange 19 of a cylinder 2. As shown in FIG. 19, the pulse duct 88 is formed onto the first conduit 36. In this arrangement, a stopper 95 of the pulse duct 88 projects beyond the connecting plane 94 to the side of the connecting flange 84 facing away from the first conduit 36.

Figure 20:
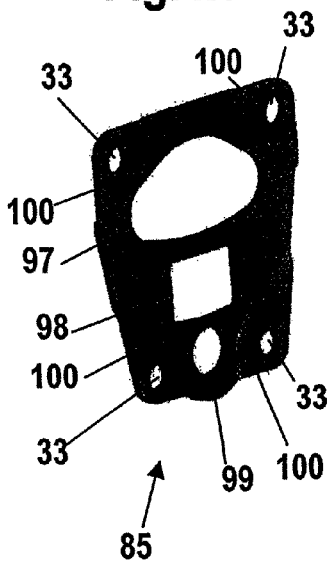
FIG. 20 shows a perspective view of the core of a connecting duct.

In FIG. 20 the core 85 is shown in perspective. The core 85 is made from a steel plate and has a mouth opening 97 for the air duct 14, an essentially rectangular mouth opening 98 positioned below it for the mixture duct 16 and a circular mouth opening 99 for the pulse duct the flange 19 of the cylinder 2.

The specification incorporates by reference the disclosure of German priority document DE 203 13 567.9 filed Sep. 2, 2003 as well as U.S. application Ser. No. 10/922,332 filed Aug. 20, 2004.

The present invention is, of course, in no way restricted to the specific disclosure of the specification and drawings, but also encompasses any modifications within the scope of the appended claims.

We claim:

1. An internal combustion engine of a manually operated implement, wherein said engine has an inlet for the supply of fuel/air mixture and an air duct window, comprising:

an elastic connecting duct disposed between said internal combustion engine and an air filter for vibration-decoupled bridging of a vibration gap between said engine and the air filter, said elastic connecting duct having a first conduit for fuel/air mixture, wherein said first conduit has a bore extending from a first end to a second end of said first conduit, and a second conduit for largely fuel-free air, wherein said second conduit has a bore extending from a first end to a second end of said second conduit, wherein said first conduit and said second conduit are embodied as separate tubes, wherein said bore in said first conduit and said bore in said second conduit are separated from one another over their entire lengths, wherein said inlet of said engine is operatively connected to the air filter via said first conduit, and wherein said air duct window is operatively connected to the air filter via said second conduit.

2. An internal combustion engine according to claim 1, wherein said connecting duct is provided with a connecting flange for a connection with said internal combustion engine, and wherein said first and second conduits open out at said connecting flange.

3. An internal combustion engine according to claim 2, wherein said connecting flange is provided with a core that comprises a harder material than the conduits of the connecting duct.

4. An internal combustion engine according to claim 3, wherein said connecting flange is provided with fixing openings.

5. An internal combustion engine according to claim 4, wherein said fixing openings are embodied as sleeve-shaped receivers that extend entirely through said connecting flange, and wherein said sleeve-shaped receivers are monolithically formed with said core.

6. An internal combustion engine according to claim 5, wherein said first and second conduits open out at the connecting flange in a connecting plane and wherein said sleeve-shaped receivers are set back by a distance from said connecting plane of said connecting flange.

7. An internal combustion engine according to claim 3, wherein said core is made of a duroplastic.

8. An internal combustion engine according to claim 3, wherein said core is made of metal.

9. An internal combustion engine according to claim 3, wherein said core has a plate-shaped configuration and is curved at a plane of said connecting flange in the region of fixing openings thereof.

10. An internal combustion engine according to claim 2, wherein a sealing contour is formed on said connecting flange on a connecting plane thereof that faces said internal combustion engine.

11. An internal combustion engine according to claim 10, wherein said sealing contour is embodied as a sealing bead that is disposed in a groove.

12. An internal combustion engine according to claim 2, wherein said first and second conduits, at respective ends thereof that face away from said connecting flange, are provided with plane-parallel flange planes, wherein said flange planes of said two conduits are spaced from one another, and wherein said first conduit is shorter than said second conduit.

13. An internal combustion engine according to claim 1, wherein said first conduit is connected to a carburetor.

14. An internal combustion engine according to claim 1, wherein said first conduit has an approximately circular flow cross-section, wherein said second conduit, on an end that faces said air filter, has an approximately circular flow cross-section and at an end that faces said internal combustion engine has a flow cross-section having a minimum height, measured in the direction of a longitudinal axis of a cylinder of said internal combustion engine, that is smaller than a maximum width that is measured approximately in a peripheral direction of said cylinder, and wherein said minimum height of said second conduit, at said end that faces said internal combustion engine, is less than half of said maximum width.

15. An internal combustion engine according to claim 14, wherein said minimum height of said second conduit, at said end that faces said internal combustion engine, is less than one fourth of said maximum width.

16. An internal combustion engine according to claim 1, wherein at least one of said conduits is provided with a reinforcement.

17. An internal combustion engine according to claim 16, wherein said reinforcement is embodied as a ridge that extends around one of said conduits.

18. An internal combustion engine according to claim 16, wherein said reinforcement is embodied as a strut that extends in a longitudinal direction of said conduits.

19. An internal combustion engine according to claim 18, wherein said strut is disposed in one of said conduits, and wherein said conduit is divided into two branches.

20. An internal combustion engine according to claim 1, wherein said first and second conduits have a seam-free inner wall.

21. An internal combustion engine according to claim 1 which is further more provided with a pulse duct.

22. An internal combustion engine according to claim 1, wherein said first and second conduits are made of an elastomer.

23. An internal combustion engine according to claim 22, wherein said connecting duct is embodied as an elastomeric farmed part and is provided with a duroplastic insert that is positively held in said formed part.

24. An internal combustion engine of a manually operated implement, wherein said engine has an inlet for the supply of fuel/air mixture and an air duct window, comprising:

an elastic connecting duct disposed between said internal combustion engine and an air filter for vibration-decoupled bridging of a vibration gap between said engine and the air filter, said elastic connecting duct having a first conduit for fuel/air mixture, wherein said first conduit has a bore extending from a first end to a second end of said first conduit, and a second conduit duct for largely fuel-free air, wherein said second conduit has a bore extending from a first end to a second end of said second conduit, wherein said first conduit and said second conduit are embodied as separate conduits, and wherein said bore in said first conduit and said bore in said second conduit are separated from one another over their entire lengths, wherein said connecting duct is provided with a connecting flange that is connected to said internal combustion engine, wherein said first conduit opens out at said connecting flange with a first mouth opening at the connecting flange, wherein said second conduit opens out at said connecting flange with a second mouth opening separate from the first mouth opening, wherein said inlet of said engine is operatively connected to the air filter via said first conduit, and wherein said air duct window is operatively connected to the air filter via said second conduit.

* * * * *